US005500964A

United States Patent [19]

Bergersen

[11] Patent Number: 5,500,964

[45] Date of Patent: Mar. 26, 1996

[54] PATIENT MANIPULATING KIT AND METHOD OF CONVERTING A HOSPITAL BED TO A PATIENT MANIPULATION APPARATUS

[75] Inventor: Øivind Bergersen, Askim, Norway

[73] Assignee: National Health Equipment, Inc., Costa Mesa, Calif.

[21] Appl. No.: 209,114

[22] Filed: Mar. 9, 1994

[51] Int. Cl.[6] ..... A61G 7/06

[52] U.S. Cl. ..... 5/607; 5/612; 5/613; 5/614; 5/630

[58] Field of Search ..... 5/607, 608, 609, 5/612, 613, 614, 619, 620, 630, 632, 660

[56] References Cited

U.S. PATENT DOCUMENTS

| | | | |
|---|---|---|---|
| 842,973 | 2/1907 | Preston | 5/613 |
| 3,300,793 | 1/1967 | Thompson | 5/613 X |
| 4,084,274 | 4/1978 | Willis et al. | 5/613 X |
| 4,387,888 | 6/1983 | Marinakis . | |
| 4,654,903 | 4/1987 | Chubb et al. . | |
| 4,658,450 | 4/1987 | Thompson . | |
| 4,941,221 | 1/1990 | Kanzler | 5/607 X |
| 4,944,054 | 7/1990 | Bossert . | |
| 5,224,228 | 7/1993 | Larrimore . | |
| 5,303,437 | 4/1994 | Huney | 5/607 X |

*Primary Examiner*—Michael F. Trettel
*Attorney, Agent, or Firm*—Fulwider, Patton, Lee & Utecht

[57] ABSTRACT

A method for converting a patient bed or chair to a patient manipulating device by selecting a kit including a subframe having a central hinge plate carrying a pair of left and right articulated wing support devices for complementary conformity to the underlying support surface. An opening is cut in the back support of the bed and chair, the subframe installed thereover and a pair of left and right actuators inserted behind such support surface and coupled with such wing devices to selectively raise the respective wings upwardly relative to the sub-frame and patient support surface.

15 Claims, 3 Drawing Sheets

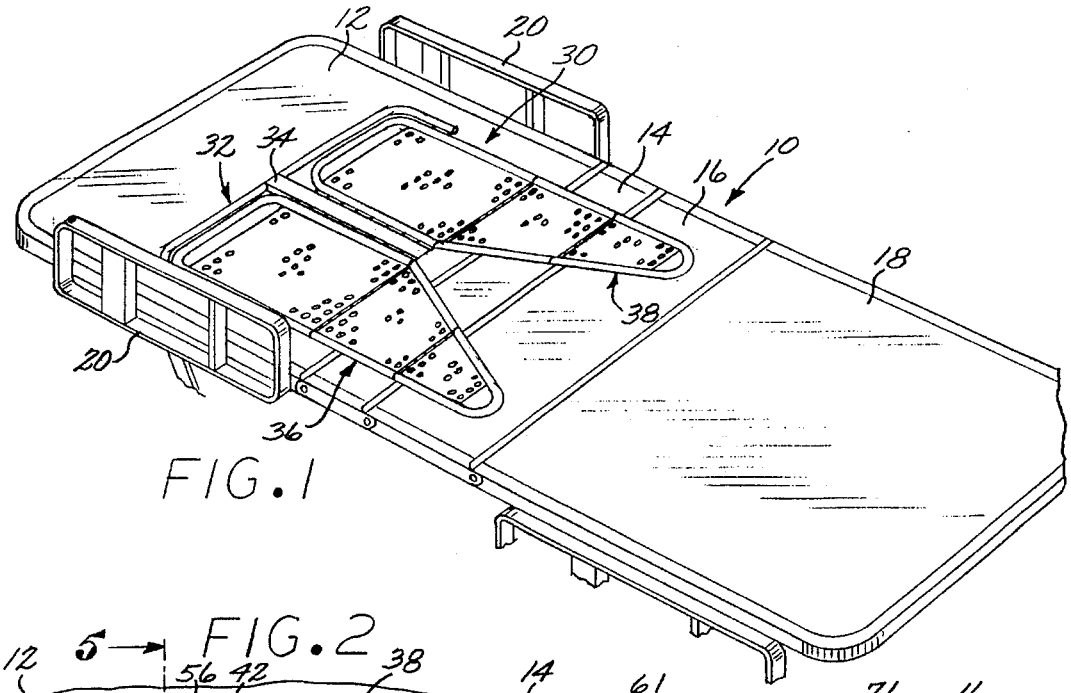
FIG. 1
FIG. 2
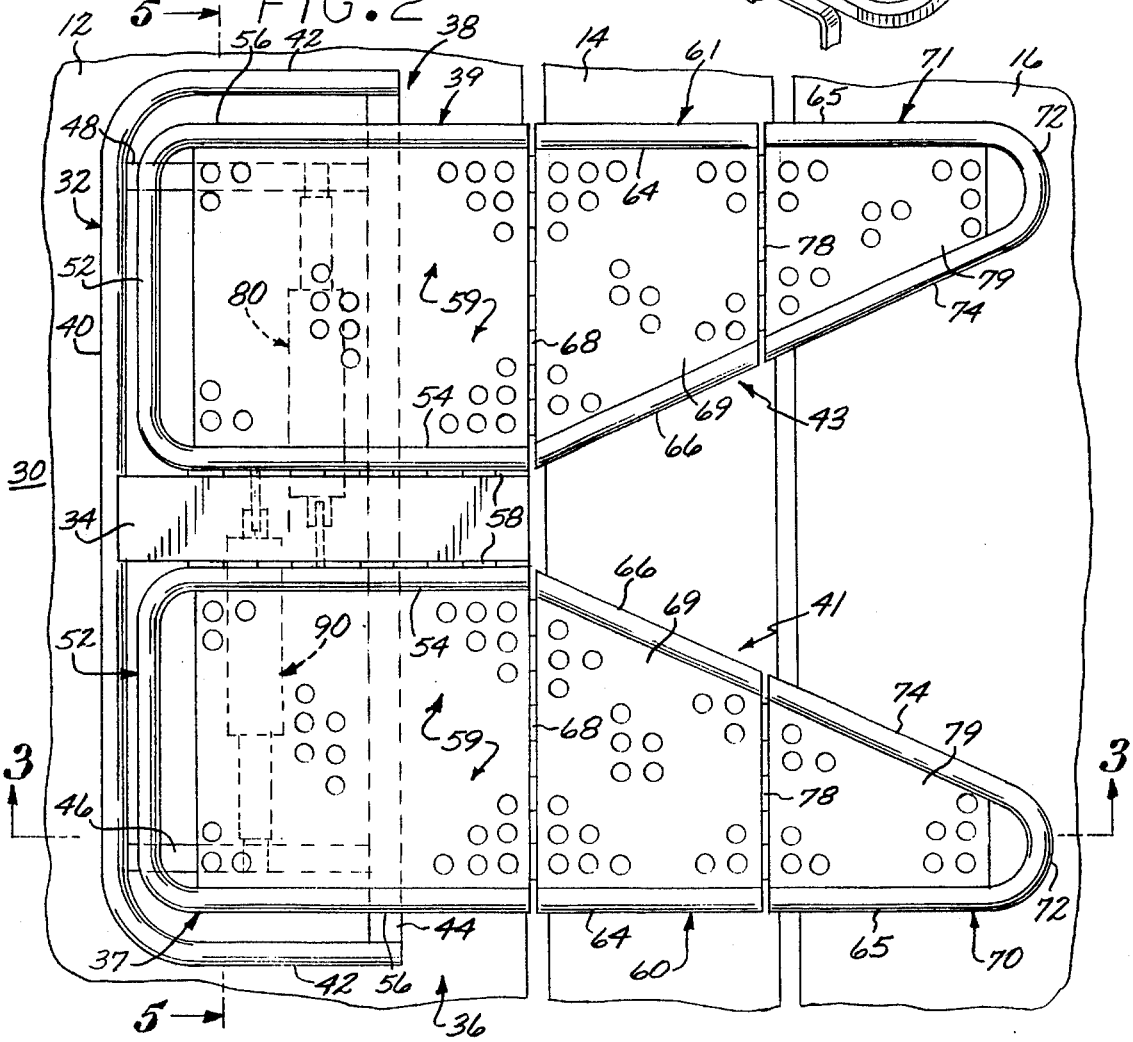

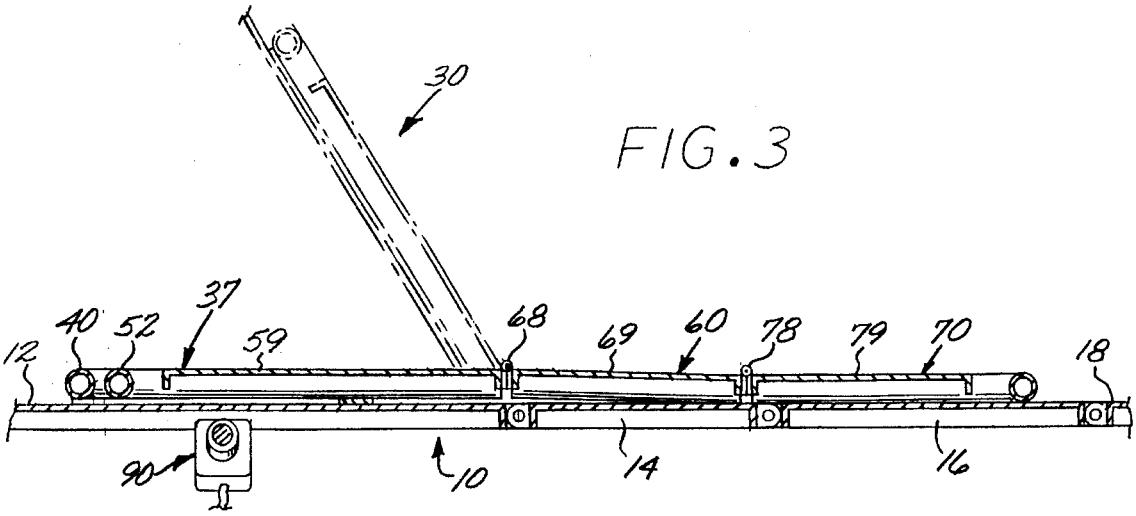
FIG. 3
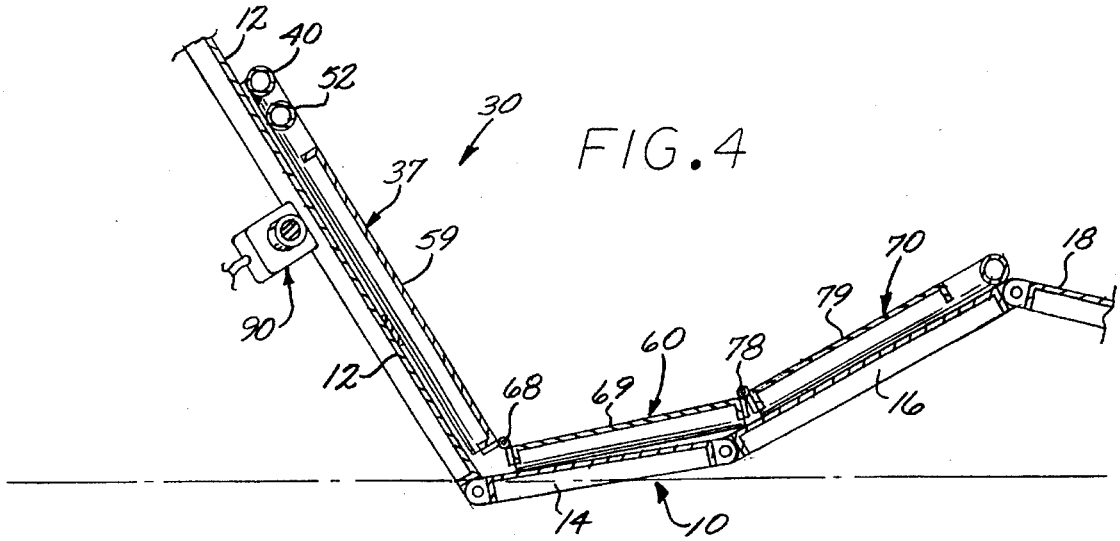
FIG. 4
FIG. 5
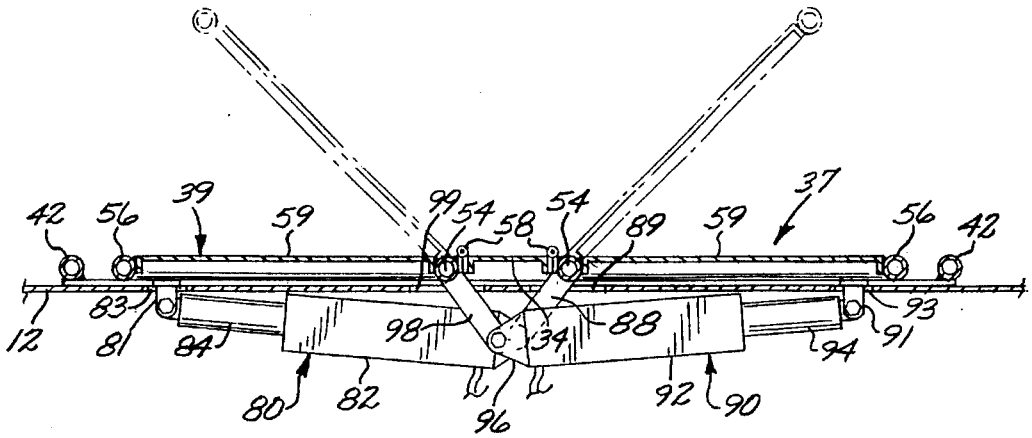

PATIENT MANIPULATING KIT AND METHOD OF CONVERTING A HOSPITAL BED TO A PATIENT MANIPULATION APPARATUS

BACKGROUND OF THE INVENTION

1. Field of the Invention

The present invention relates to devices for repositioning an individual when seated or lying down and, more particularly, to a device for remedying and preventing decubitus "pressure" ulcers, pain and other medical maladies.

2. Description of the Related Art

A pressure ulcer is an injury usually caused by unrelieved pressure that damages the skin and underlying tissue. Pressure ulcers are also referred to as bed sores and range in severity from mild (minor skin reddening) to severe (deep craters down to muscle and bone). Unrelieved pressures on the skin squeeze peripheral blood vessels, which supply the skin with nutrients and oxygen. In general, when skin is starved of nutrients and oxygen for extended periods of time, the underlying tissue will die and a pressure ulcer may form. Pressure ulcers usually form where bone causes the greatest force on the skin and tissue and squeezes the skin and tissue against an outside surface.

This may be where bony parts of the body press against a support surface such as a mattress or chair cushion. In persons who are bedridden, most pressure ulcers form on the lower back below the waist (sacrum), the hip bone (trochanter) and the heels. For people sitting in chairs, be it conventional or wheelchairs, the exact location where pressure ulcers form depends on the prolonged sitting position. Pressure ulcers can also form on the knees, ankles, shoulder blades, back of the head and spine. Anyone confined for prolonged periods to a bed or chair, because of illness or injury, is exposed to the prospect of developing pressure ulcers.

Other scenarios may lead to the development of pressure ulcers as well. For instance, an individual subjected to repeated sliding motions in a bed or chair is exposed to the danger that blood vessels will be stretched or bent thus restricting or blocking blood circulation and resulting in the attendant risk of pressure ulcer formation. Even slight rubbing or friction on the skin may restrict blood flow causing irritation and possible minor pressure ulcers.

Nerves normally "signal" the discomfort associated with restricted peripheral circulation thus inducing the patient to move and relieve the pressure on a point or points. However, fully or partially incapacitated patients, unable to move on their own, cannot respond to the pressure induced discomfort and may develop pressure ulcers in as little as one to two hours. Individuals restricted to wheelchairs sitting in an upright position may develop pressure ulcers in even less time since the localized pressure on the effected skin and tissue tends to be greater.

Pressure ulcers pose a serious problem which may lead to pain, extended hospital or nursing home confinement, and can result in a slower recovery from health problems. In today's health care environment, the cost attendant delayed release from a hospital stay is viewed as a serious matter. The policy at many hospitals is to delay the release of patients having pressure ulcers until such ulcers are totally cured thus often increasing the duration of the stay and correspondingly driving up the cost of health care.

Fortunately, it is possible to prevent the formation of most pressure ulcers and to effectively treat those formed provided treatment is sought during the early stage. The most effective way of preventing and alleviating pressure ulcers is to simply reposition the individual periodically to shift the weight from one area to another.

Guidelines have been established for patient care facilities to follow in effort to prevent or alleviate such ulcers. For instance, a *Clinical Practice Guideline, Pressure Ulcers in Adults: Predicting and Prevention* (Publication #92-0047, May 1992) published by the U.S. Agency for Health Care Policy and Research, suggests that:

1. Any individual in bed who is assessed to be at risk for developing pressure ulcers should be repositioned at least every two hours; and
2. Any person at risk of developing pressure ulcers should avoid uninterrupted sitting in any chair or wheelchair. The individual should be repositioned, shifting the points under pressure, at least every hour. Individuals who are able to do so, should be taught to shift their weight every 15 minutes.

Such repositioning may be accomplished, when the manpower is available, by patient care clinicians and attendants who physically move the patient at these recommended frequencies. However, hospital clinicians may inadvertently not adhere to these repositioning guidelines and, even when attempting to reposition the patient, the clinician is often faced with a difficult task in endeavoring to lift or roll the patient to new positions without exposing the patient to undue discomfort. In addition, depending on the weight of the patient and strength of the clinician, often the clinician is found to drag or slide the patient in effort to effect repositioning thus causing friction that may aggravate pressure ulcers or rub off the top layer of skin damaging underlying blood vessels.

Commonly, in the busy schedule of hospital staff, there is inadequate help available at the time a patient is to be turned thus leaving the available clinician with the dilemma of making the election to neglect the scheduled turn or undertaking the task shorthanded and exposing himself or herself to the risk of physical injury from undertaking the manipulating of a heavy load, often while assuming an awkward, high risk bending position.

In effort to overcome these apparent inadequacies, others have developed methods and devices to assist the clinician in alleviating and preventing pressure ulcers. One method is to use special mattresses that includes flowable foam, air, gel or water to equalize pressure over the surface of the body. Although these specially designed mattresses may provide some degree of relief, they have been found ineffective to completely prevent or alleviate all incidence of pressure ulcers.

Manipulating devices have been proposed with central, longitudinal hinges to pivot wings or flaps up from a horizontal support surface and to raise a flap about a transverse hinge. Devices of this type are disclosed in U.S. Pat. No. 5,224,228 to Larrimore showing a hospital bed and in U.S. Pat. No. 4,387,888 to Marinakis showing an examination table for providing limited repositioning a human body. Although these devices may provide limited relief in alleviating and preventing some pressure ulcer development, they suffer the shortcoming that they are of relatively complicated construction, expensive to manufacture and are of limited utility in cooperating with present day hospital beds having articulated frames configured to adjust the relative position of the patient's back, legs and buttocks.

Hence, it has been desirous of those skilled in the art to provide a device which can effectively and conveniently reposition a patient to multiple different orientations to alleviate or prevent the development of pressure ulcers and enhance patient comfort. Such a device should be easily operable, durable, and relatively inexpensive to manufacture. In addition, the device should be adaptable for use with and conform to patient support devices having articulated movable support surfaces and should not restrict the articulated movement incorporated therein.

SUMMARY OF THE INVENTION

The invention provides a patient manipulating kit for repositioning an individual thereon and method of attachment thereof to a patient support device having articulated support surfaces. The manipulating kit includes a subframe having a central hinge plate and a pair of right and left wing devices coupled thereto. The right and left wing devices include a pair of respective right and left shoulder support wing devices and a pair of lower right and left wing devices hingedly connected to the respective shoulder support wing devices. The subframe may be attached to an articulated surface of the patient support device wherein the respective right and left wings may be operatively rotated about the hinge plate to conveniently raise the respective wings relative to the subframe and patient support device for effectively repositioning a patient carried thereon.

Other features and advantages of the invention will become apparent from the following detailed description, taken in conjunction with the accompanying drawings which illustrate by way of example, the features of the invention.

BRIEF DESCRIPTION OF THE DRAWINGS

FIG. 1 is a perspective view of a patient manipulating kit embodying the present invention and mounted to a hospital bed having articulated support surfaces;

FIG. 2 is an enlarged partial top plan view of the patient manipulating kit shown in FIG. 1;

FIG. 3 is a longitudinal sectional view taken substantially along line 3—3 of FIG. 2;

FIG. 4 is a longitudinal sectional view similar to FIG. 3 but illustrating complementary conformity to the articulated support surfaces of the bed;

FIG. 5 is a transverse sectional view taken substantially along line 5—5 of FIG. 2;

DETAILED DESCRIPTION OF THE PREFERRED EMBODIMENT

Figure 6:
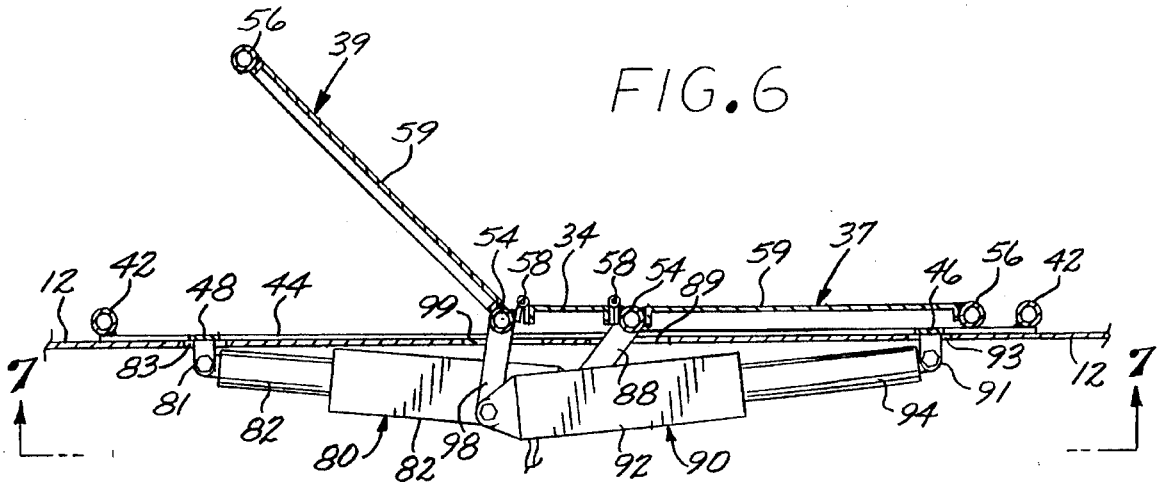
FIG. 6 a transverse sectional view similar to FIG. 5, but showing one support wing device of the invention in an upwardly elevated position.

As shown in the drawings for purposes of illustration, the invention is embodied in a patient manipulating kit and method of converting a patient support device having articulated surfaces to an apparatus for manipulating the weight of a patient. The patient manipulating kit is operable to reposition a patient's body parts to reposition the pressure support points to prevent and alleviate decubitus pressure ulcers, pain and other medical maladies.

Pressure ulcers are injuries usually caused by unrelieved pressure that damages the skin and underlying tissue. Pressure ulcers usually form where bone causes the greatest force on the skin and tissue and squeezes the skin and tissue against a support surface. Individuals restricted to bed and chairs, who are unable to move on their own, may develop pressure ulcers in a very short period of time. Pressure ulcers are serious injuries that lead to pain and potentially longer hospital and nursing home stays that drive up medical expenses as a result of slower recovery stemming from these health problems not associated with the original ailment. The most effective way of preventing and alleviating pressure ulcers is to simply reposition patients at regular intervals to shift the weight from one pressure point area to another thereby regularly relieving the localized pressure to assume blood circulation in the areas relieved.

Referring to the FIGURES, the preferred embodiment of the invention, briefly and in general terms, provides a patient manipulating kit 30 that may be attached to a patient support device 10 having articulated support sections or surfaces. The manipulating kit includes a stationary subframe, generally designated 32, having a longitudinal central hinge plate 34 having a pair of left and right support wing devices, generally designated 36 and 38, hingedly connected to the opposite sides thereof. The wing devices include respective upper left and right rectangularly shaped shoulder wing support devices 37 and 39 having respective left and right triangularly shaped lower support wing devices 41 and 43 hingedly connected to the bottom edges thereof. The subframe may be anchored to a shoulder support surface 12 of the patient support device 10 so the respective right and left wing devices may be selectively rotated about the central hinge plate 34 to conveniently raise the respective wing devices 36 and 38 causing the articulated shoulder and lower wing devices 37, 39, 41 and 43 to, in contour fashion, raise the weight of the overlying portion of the patient's body to effectively reposition the weight of the patient. It is to be appreciated that a bed overlay, such as a mattress, would overlay the bed support surfaces and the manipulating kit in the operative environment.

Referring more particularly to FIG. 1, the patient manipulating kit 30 is shown mounted to a patient support device, such as hospital bed 10, having a dynamic adjustable integrated surface. It will be appreciated that hospital beds are typically constructed as such to articulate for the purpose of selectively raising the patient's head and/or knees and legs while supporting the body in a comfortable position. To this end, the bed 10 typically incorporates the shoulder and head support panel 12, buttocks and lower back support panel 14, a thigh support panel 16 and lower leg panel 18 all hingedly connected together for articulation by either crank, electric motor or fluid cylinder mechanisms. The bed also typically includes a pair of retractable side rails 20 to restrain a patient lying on the bed from falling off. It is one of the benefits of the patient manipulation kit of the present invention that it can be easily and quickly installed over such an articulate bed to cooperate with the various different contoured positions thereof to comfortably and effectively shift the patient to different selected positions. Illustrated in FIG. 1, the support surfaces of the bed are in horizontal positions relative to one another and the patient support wing devices 36 and 38 are in an overlying conforming non-elevated position thereon.

Referring more particularly to FIG. 2, the subframe 32 of the patient manipulating kit 30 overlies the shoulder support panel 12 of the bed 10. The subframe 32 is generally formed as an open frame including a U-shaped tube defining a laterally extending top frame member 40 formed at each extremity with downwardly projecting side frame members 42. When mounted, the top and side members rest on the shoulder support 12. Connected between the lower extremities of the side members 42 is a transverse strap 44. Disposed slightly inward of the side members 42 and interposed between the top frame member 40 and transverse strap 44 are left and right vertical mounting straps, 46 and 48 respectively. The central axial hinge plate 34 is fixedly attached at its top end to the top member 40 and extends downwardly to overly and be fixedly attached to the transverse strap 44.

Figure 8:
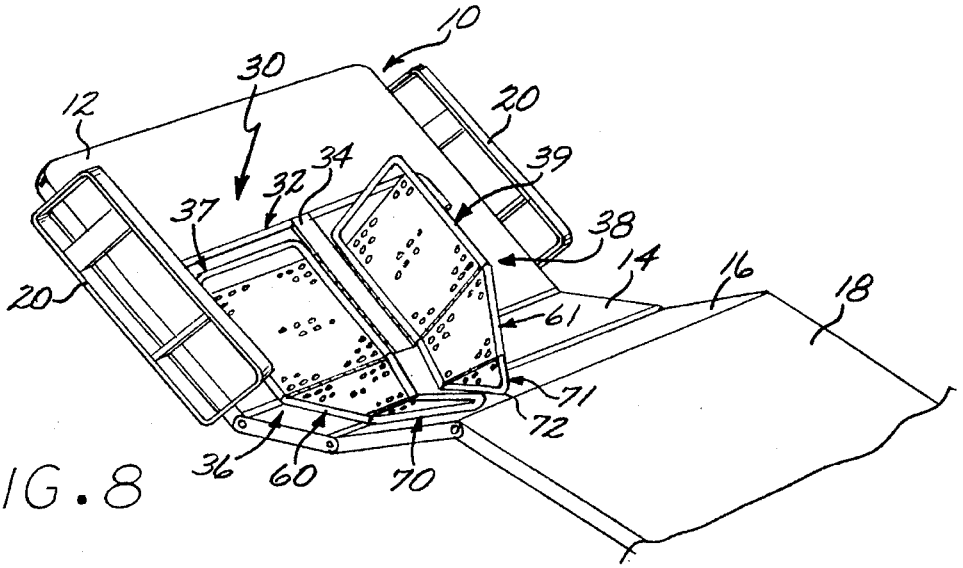
FIG. 8 is a partial perspective view similar to FIG. 1, and showing a support wing device of the invention in an elevated position and illustrating complementary conformity to the articulated support surface of the bed.

The support wing devices 36 and 38 are formed as articulated bodies including the respective shoulder wing devices 37 and 39 (FIG. 2) and lower wing devices 41 and 43. The lower wing devices are further articulated into respective medial buttock wing devices 60 and 61 and leg wing devices 70 and 71. The respective shoulder wings include respective U-shaped metal tubular frames with the closed ends defining respective upper rails 52 and the opposite legs defining respective vertical inner and outer rails 54 and 56, respectively. The inner rail 54 of each U-shaped frame is hingedly attached to the central hinge plate 34 generally along the outer extent thereof by respective hinge plate hinges 58. It will be appreciated that in some embodiments of the present invention such hinges may be combined so that their hinges coincide. Spanning the interior of such U-shaped frame are respective sheets of perforated metal defining respective shoulder support plates 59. The respective medial buttock support wings 60 and 61 are in the form of truncated right triangles and are hingedly connected at their respective upper extremities to the respective shoulder wings 37 and 39 by means of respective transverse piano style hinges 68. Such buttock wings 60 and 61 cooperate with the leg wings 70 and 71 to, as viewed in plan view in FIG. 2, form a rigid triangle, the respective leg wings being connected to the buttock wings 60 and 61 by means of transverse piano hinges 78. The respective buttock and leg wings 60 and 61 and 70 and 71 include peripheral tubular frames in the form of vertical outside tubular sections 64 and 65 and angular medial runs 66 and 74, the lower support wing devices 41 and 43 being integrated and formed on their respective bottom ends with respective turned back U-sections 72 which act as camming surfaces sliding across the thigh support panel 16 when a wing is elevated while the bed shoulder support 12 is in the raised position as shown in FIG. 8. Within the respective peripheral frames are respective perforated metal sheets defining wing support plates 69 and 79. Left and right wing actuators 80 and 90, respectively (shown in phantom), are provided to raise the respective left and right wing devices 36 and 38 as will be described further below.

Referring to FIG. 3, the subframe 32 of the patient manipulating kit 30 may be floatingly mounted on the shoulder support panel 12 of the bed 10. It can be appreciated, as illustrated in phantom, that the subframe 32 and shoulder wing devices 37 and 39 overlay the shoulder support panel 12, while the respective buttock and leg wing devices 60 and 61 and 70 and 71 are disposed in complementary position over the buttocks 14 and thigh 16 support panels of the bed.

Figure 7:
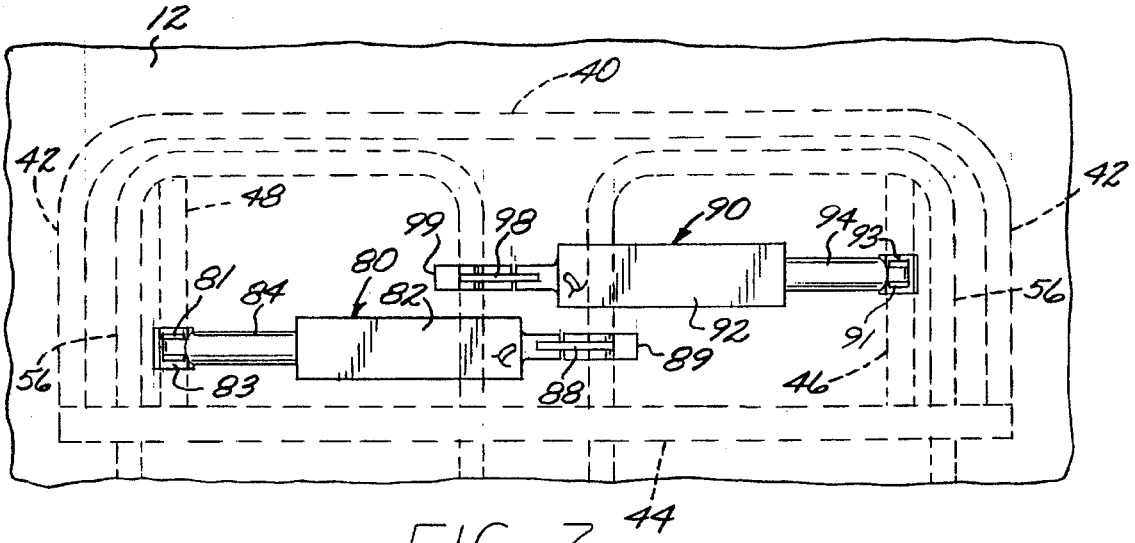
FIG. 7 is a partial bottom view in enlarged scale taken substantially along line 7—7 of FIG. 6.

As shown in FIGS. 5, 6 and 7, the patient manipulation kit further includes respective left and right base brackets 91 and 81 fixedly secured to the respective left and right mounting straps 46 and 48 to project downwardly, when the kit is mounted to the bed 10, through the respective bracket openings 83 and 93 formed in the shoulder support panel 12. The shoulder wing devices 37 and 39 include, at their inner vertical rails 54, respective downwardly projecting right and left crank arms 88 and 98, each projecting through respective left and right crank arm openings 89 and 99 formed in the shoulder support panel 12. The left and right wing actuators 80 and 90 are interposed between the respective crank arms and base brackets. In one embodiment as illustrated, the left and right actuators are of a pneumatic piston/cylinder type having respective cylinders 82 and 92 and pistons 84 and 94 which are extendable upon air pressure being exerted upon the pistons 84 and 94 therein. The respective extremities of the pistons are pivotally mounted to the bottom of the respective base brackets 81 and 91 and the respective extremities of the left and right actuation cylinders 82 and 92 are pivotally mounted to the downward extremities of the left and right crank arms 88 and 98. It is to be appreciated that the actuators 80 and 90 may be of various mechanical configurations. For instance, the actuators may be of an electric or manual screw jack configuration. It is to be appreciated that the actuators 80 and 90 may be operated by a programmable control device in which a clinician may set the frequency and degree of elevation for either the left 36 or right 38 wing devices or both. In this fashion, a clinician may conveniently program the control device to effectively reposition the patient at a selected desired frequency, assuring the patient is repositioned even when clinicians might not otherwise be available.

From the foregoing, it is to be appreciated that the patient manipulating kit can be fabricated in a relatively inexpensive and convenient manner and is lightweight and thus economical to ship. In addition, the dimensions and sizes of the patient manipulation kit components may be varied and custom fit to a particular bed, chair or the like. The size of the shoulder and lower wing devices 37, 39, 41 and 43 and the buttock, and leg wings 60, 61, 70 and 71 corresponding thereto can be sized to complementally conform to a variety of underlying support surfaces.

Referring to the FIGURES, to convert a hospital bed to a patient manipulating apparatus, a technician will arrive at a hospital or the like where a bed is to be converted. The technician selects a patient manipulating kit 30 appropriately configured and sized for a particular articulated bed 10. The technician will thereafter remove the conventional mattress and bed clothes from the bed to attain access to the articulated bed support surfaces. The technician may now unpackage the kit and cut the crank arm and bracket openings 89, 99, 83 and 93 at the specific locations in the bed shoulder support surface 12 in alignment with the respective brackets 81 and 91 and crank arms 88 and 98 of the kit. This can be accurately achieved by overlying the shoulder support surface 12 of the bed with a template or the like. Thereafter, with the left and right actuators 80, 90 disengaged from the subframe 32, the technician aligns the subframe over the support surface and aligns the respective mounting brackets 81, 91 and crank arms 88, 98 over the respective bracket and crank arm openings and places the subframe over the shoulder support surface wherein the mounting brackets and crank arms project downwardly through the respective openings. The technician may now fixedly secure the subframe to the back support by conventional means such as by bolting or welding. Subsequently, the technician attaches the left and right actuators 80, 90 to the respective crank arms and mounting brackets beneath the back support. The actuators may now be connected to a control device (not shown) which operatively raises the left and right wing devices 36 and 38 relative to the bed. The mattress overlay (not shown)

may now be placed atop the now completed patient manipulation apparatus. From the foregoing, it can be appreciated that a hospital bed may be easily, conveniently and rapidly converted to a patient manipulating apparatus.

In the assembled converted configuration, the articulated bed 10 can continue to operate in a conventional manner, uninhibited by the manipulation kit 30. As shown in FIG. 4, the patient manipulating kit 30 is illustrated with the bed 10 being in a selected articulated position, the shoulder support panel 12 being raised, and the respective thigh panel 16 and lower leg panel 18 raised to an incline to support the upper leg and knees. During manipulation of the bed to thus position, it will be clear that the respective buttock and leg wings 60, 61 and 70, 71 are free to slide, in uninhibited fashion, downwardly toward the foot of the bed as directed by the kinematics of the linkages.

In addition, with a mattress overlay positioned on the bed 10, one or the other, or both, of the actuators 80 or 90 may be actuated to raise the shoulder wing devices 37 or 39 and the respective buttock 60 or 61 and leg wing devices 70 or 71 are free to follow. When it is desirable to shift a patient, say toward his or her right side, the support wing device 38 may be raised. This raising of the wing device 38 will be achieved by extending the actuator 90, as shown in FIG. 6, to rotate the crank arm 98 about its hinge 58 thus raising the lateral outer edge of such support wing device 38 to thereby gently and gradually raise the left shoulder of the patient to the elevation desired. When this task is undertaken with the bed in its lowered, flat position shown in FIG. 1, raising of the shoulder wing 39 will correspondingly raise the buttock and leg wings 61 and 71 to thus simultaneously raise the patient's shoulder, buttocks, and upper leg area. This then tends to shift the patient's weight off the left side of his or her body thereby transferring the pressure points to the right side of the body. Then, this position may be adjusted from an extreme elevated position to a somewhat lowered position as desired. Similarly, to shift the patient's weight back to the left hand side of the body, the actuator 90 will be contracted to lower the support wing 38 and the actuator 80 extended thereby rotating the crank arm 88 counterclockwise, as viewed in FIG. 6, to likewise rotate support wing device 36 counterclockwise to elevate its lateral outer edge thereof.

The patient maneuvering system of the present invention has the additional advantage that it is effective to shift the patient's position while the patient is in a partial sitting position or even with his or her knees are raised slightly as would be the case for the bed position shown in FIGS. 4 and 8. In this instance, when the wing support device 38 is raised, the shoulder support wing 39 may orbit about its hinge axis 58 extending parallel to the shoulder support panel 12 at an angle of up to about 60° to the horizontal. This then serves to orbit the bottom end of the lower wing device 43 out away from the shoulder support panel 12 to likewise kick the buttock wing device 61 and leg wing device 71 out away from such shoulder support panel 12 causing the U-shaped cam surface 72 to essentially skid along the underlying thigh support panel 16. It will be noted that the downward and outward taper of the laterally inner edges 66 and 74 of the respective buttock and leg wings 61 and 71, along the line defined by the respective angular medial runs 66 and 74, provide clearance for the leg wing 71 to be driven laterally inwardly as the support wing 38 is raised. In addition, the lateral dimension of the central hinge plate 34 provides clearance between the leg wings 70 and 71 may prevent the mattress overlay from buckling if both wing devices 36 and 38 are raised simultaneously while providing lateral breadth to nest the patient therein when in this configuration. This articulation then tends to slide the frame of the leg wing 71 to slide the laterally inner medial runs 74 and U-shaped cam surface 72 laterally inwardly across the surface of the bed upper thigh support panel 16 underneath the mattress overlay to thus tend to hoist the patient's buttocks upwardly and over to the patient's right hand side of the bed 10 thus tending to exaggerate shifting of the patient's weight. This function is accomplished by the relative articulation between the respective shoulder, buttocks and thigh support wings 39, 61 and 71 with only the moving force provided by the actuator 90. Accordingly, this allows for effective patient manipulation to a multitude of different positions, depending on the degree to which the support wing device 38 is raised, and the corresponding compound travel of the respective buttock and leg wings 61 and 71.

In accordance with another embodiment of the invention the elements of the patient manipulating kit may be integrally formed with a patient support device. The subframe 32 of the kit would be formed integrally with the bed frame and the wing support devices 36 and 38 would be integrally manufactured to conform to the articulated support surfaces of the bed.

From the foregoing, it can be appreciated that applicant's invention provides an economical and reliable means for assembling a lightweight patient manipulating kit to a patient support device having articulated support surfaces. The resultant assembly allows a medical clinician to conveniently and effectively reposition a patient to alleviate and prevent the development of decubitus pressure ulcers.

While particular forms of the invention have been illustrated and described, various modifications can be made without departing from the spirit and the scope of the invention. Accordingly, it is not intended that the invention be limited, except as by the appended claims.

What is claimed is:

1. A patient manipulating kit for attachment to a patient support device of the type formed with a main frame including an upwardly facing, generally horizontally disposed shoulder support panel formed with at least one axis opening and comprising:

a subframe for overlaying said shoulder support panel and including a laterally projecting head rail and a central hinge plate projecting longitudinally downwardly and a pair of laterally disposed side members and respective laterally disposed mounting straps, said subframe further including a pair of driver base brackets mounted from the respective said straps and positioned to, when said frame is in position over said shoulder panel, project downwardly through said opening;

respective laterally projecting right and left shoulder wing devices for positioning in overlying relation on the respective said shoulder panel and arranged to be raised to elevated positions raised from said shoulder panel, said wing devices being hingedly connected at their respective laterally inner edges from said hinge plate for rotation about respective hinge axes from respective retracted positions to their respective said elevated positions, said wing devices further including respective right and left crank arms for rotation to raise said wing devices from their respective lowered positions to respective said elevated positions; and a pair of right and left elongated operators removably connected between the respective right and left mounting brackets and the respective said right and left crank arms and operable to selectively rotate the respective said crank arms to rotate said wing devices between the respective lowered and raised positions whereby said frame may be positioned over said shoulder panel with the respective said mounting brackets and crank arms projecting downwardly through said opening area and the respective said operators assembled thereto to convert said patient support to a patient manipulating device.

2. The patient manipulating kit according to claim 1 for use with a patient support of the type formed with said open area in the form of a pair of laterally spaced apart central openings flanking a central strip and wherein:

said hinge plate is in the form of an elongated hinge strip for overlying said central strip and said kit includes respective right and left hinges disposed on the opposite sides of said hinge strip to define the respective said hinge axes.

3. The patient manipulating kit according to claim 1 wherein:

said shoulder wing devices include respective tubular frames defining the respective peripheries thereof and perforated plates carried within the respective tubular frames.

4. The patient manipulating kit according to claim 1 for use with a bed having a buttocks panel hingedly connected to said shoulder panel along a transverse hinge line and wherein:

said shoulder wing devices are rectangular in shape and said kit further includes respective buttock wing devices hinged to the respective said shoulder wing devices along a line overlying the said transverse hinge line for complemental articulation therewith.

5. The patient manipulating kit according to claim 4 wherein:

the respective said buttock wing devices are configured on their respective laterally inner sides with longitudinally downwardly and laterally outwardly angled clearance edges to provide clearance for laterally inward movement of the respective said buttock wing devices when the laterally outer edges of said shoulder wing devices are raised while said shoulder support panel is in a raised position relative to said buttocks panel; and a pair of right and left elongated operators removably connected between the respective right and left mounting brackets and the respective said right and left crank arms and operable to selectively rotate the respective said crank arms to rotate said wing devices between the respective lowered and raised positions whereby said frame may be positioned over said shoulder panel with the respective said mounting brackets and crank arms projecting downwardly through said opening and the respective said operators assembled thereto to convert said patient support to a patient manipulating device.

6. The patient manipulating kit according to claim 4 for use with a bed having a second transverse hinge line between said buttocks panel and an upper leg panel disposed therebelow and wherein:

said kit includes respective upper leg wing devices hingedly connected to the respective said buttock wing devices along a line overlying said second transverse hinge line.

7. The patient manipulating kit according to claim 6 wherein:

the respective said buttock and upper leg wing devices are triangularly shaped to be configured with their respective inner edges angling laterally outwardly and longitudinally downwardly.

8. The patient manipulating kit according to claim 7 wherein:

said lower leg devices are formed with cam surfaces configured and located to, when said bed shoulder support panel is raised and one of said operators is operated to raise one of said shoulder wing devices to pivot about the respective hinge axis to draw the respective said buttock and upper leg wing device laterally inwardly on said bed, the respective said cam surface will ride laterally inwardly on said upper leg panel.

9. A method of converting a patient support device of the type formed with a main body including an upwardly facing, generally horizontal support panel to a patient manipulating device including:

forming an access opening in said shoulder support panel;

selecting a kit of the type including a subframe having laterally projecting head rail and oppositely disposed side members and a central hinge plate hingedly carrying laterally projecting planar right and left shoulder wing devices rotatable to their respective raised positions;

placing said subframe over said shoulder support panel; and selecting a pair of right and left operators positioning thereon behind said shoulder support panel and coupling them between said side members and respective wing devices for operation to selectively raise the respective said wing devices to the respective said raised positions relative to said shoulder support panel.

10. A method of converting a patient support device according to claim 9 for converting a hospital bed of the type including an upper leg support panel spaced from said shoulder support panel, a buttocks support panel interposed between said upper leg and shoulder support panel and hingedly connected to both for articulation relative thereto along respective transverse, longitudinally spaced apart first and second hinge lines, that includes:

selecting said kit of the type including buttock wing devices hingedly connected to the bottom of the respective said shoulder wing devices for rotation about respective first hinges and upper leg wing devices hingedly connected to the bottoms of the respective said buttock wing devices for rotation about respective second hinges and wherein;

the position of said kit on said shoulder panel includes aligning the respective said first and second hinges over the respective said first and second hinge lines.

11. A method of converting a patient support device according to claim 10 wherein:

the step of selecting said kit includes selecting said kit with the respective said buttock and upper leg wing devices configured at their respective laterally inner sides with edges angling downwardly and laterally outwardly to form, near their respective bottom ends, respective cam surfaces; and the step of placing said kit on said shoulder support panel includes locating said kit such that, when said shoulder panel is in a raised position relative to said buttocks panel and one of said operators is actuated to raise one of said shoulder wing devices, the corresponding buttock and upper leg wing devices will be drawn laterally inwardly to draw the respective said cam surface across the surface of said upper leg support panel.

12. A lifting patient manipulating apparatus comprising:

a patient support device including an upwardly facing shoulder support panel and a buttocks support panel hingedly connected to said shoulder support panel for articulation along a first transverse hinge line;

a pair of right and left shoulder wing devices overlying the opposite sides of said shoulder support panel;

a longitudinal hinge device coupling said shoulder wing devices together at their laterally inner edges for rotation of the respective wing devices to respective elevated positions;

a pair of lower wing devices overlying said buttocks support panel and hingedly connected to the respective said shoulder wing devices for rotation relative thereto along respective hinge axes overlying said first hinge line; and right and left operators coupled with the respective said right and left shoulder wing devices for rotating said shoulder wings to the respective said elevated positions carrying the respective lower wing devices therewith.

13. A patient manipulation apparatus according to claim 12 wherein:

said lower wing devices include respective buttock and upper leg wing devices hingedly connected together along respective transverse hinge lines.

14. A patient manipulation apparatus according to claim 13 wherein:

the respective said buttock and upper leg wing devices are formed medially with respective edges which angle downwardly and outwardly.

15. A patient manipulation apparatus according to claim 14 wherein:

said upper leg wing devices are formed on their lower ends with cam surfaces arranged to, when the respective said operators are operated to raise the respective said wing devices while said shoulder panel is raised about said first hinge line, be drawn across the surface of said upper leg panel.

* * * * *